US010061223B2

(12) United States Patent
Yaguchi

(10) Patent No.: US 10,061,223 B2
(45) Date of Patent: Aug. 28, 2018

(54) IMAGE FORMING APPARATUS

(71) Applicant: CANON KABUSHIKI KAISHA, Tokyo (JP)

(72) Inventor: Kazutaka Yaguchi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/712,484

(22) Filed: Sep. 22, 2017

(65) Prior Publication Data

US 2018/0101108 A1 Apr. 12, 2018

(30) Foreign Application Priority Data

Oct. 6, 2016 (JP) ..... 2016-198119

(51) Int. Cl.

| | |
|---|---|
| ***G03G 15/00*** | (2006.01) |
| ***G03G 15/02*** | (2006.01) |
| ***G03G 15/043*** | (2006.01) |
| ***G03G 15/16*** | (2006.01) |

(52) U.S. Cl.

CPC ..... *G03G 15/0266* (2013.01); *G03G 15/5037* (2013.01); *G03G 15/043* (2013.01); *G03G 15/1645* (2013.01)

(58) Field of Classification Search

CPC ..... G03G 15/0266; G03G 15/043; G03G 15/1645; G03G 15/5037

See application file for complete search history.

(56) References Cited

U.S. PATENT DOCUMENTS

| | | | | |
|---|---|---|---|---|
| 9,268,282 | B2 | 2/2016 | Saito et al. | |
| 9,310,709 | B2 | 4/2016 | Yaguchi | |
| 9,753,393 | B2 * | 9/2017 | Yaguchi | G03G 15/0266 |
| 2007/0160377 | A1 * | 7/2007 | Sakuwa | G03G 15/0266 399/50 |
| 2016/0274482 | A1 * | 9/2016 | Jota | G03G 15/0266 |

FOREIGN PATENT DOCUMENTS

| | | | |
|---|---|---|---|
| JP | 2015-094858 | A | 5/2015 |
| JP | 2015-135469 | A | 7/2015 |

* cited by examiner

*Primary Examiner* — Joseph S Wong

(74) *Attorney, Agent, or Firm* — Fitzpatrick, Cella, Harper & Scinto

(57) ABSTRACT

In an image forming apparatus, a control unit performs a control for determining a surface potential A to determine a first voltage to be applied to a charge roller by a charge voltage application circuit so that a surface potential of a photosensitive drum becomes a first potential. The charge voltage application circuit thereafter applies the first voltage to the charge roller to charge the photosensitive drum. In such a state, the control unit performs a second control to determine a light amount of a laser light source, so that the surface potential of the photosensitive drum becomes a second potential. In such a manner, a potential of a photosensitive drum surface is detected with high accuracy. Moreover, a time taken to detect the potential of the photosensitive drum surface is shortened.

13 Claims, 8 Drawing Sheets

IMAGE FORMING APPARATUS

BACKGROUND OF THE INVENTION

Field of the Invention

The present invention relates to an image forming apparatus having a function of detecting a potential of an image bearing member by detecting current flowing through the image bearing member via a member.

Description of the Related Art

A contrast of an image is determined as a potential difference between a potential of a photosensitive drum surface after laser emission (hereafter, referred to as photosensitive drum potential) (VL) and a development voltage (Vdc). However, the contrast of an image varies due to an environment (temperature, humidity) and a thickness of a film on a photosensitive drum. The contrast thus needs to be corrected. Therefore, for a conventional control, for example, configurations disclosed in Japanese Patent Application Laid-Open No. 2015-094858 and Japanese Patent Application Laid-Open No. 2015-135469 are proposed as systems which sense actual photosensitive drum potentials and correcting the photosensitive drum potentials with high accuracy.

However, such systems detecting photosensitive drum potentials have been desired to perform the detection with high accuracy and to improve sequence time.

SUMMARY OF THE INVENTION

The present invention enables detection of a potential of a photosensitive drum surface with high accuracy. The present invention also enables shortening of a time taken for the detection of a potential of a photosensitive drum surface.

One aspect of the present invention is an image forming apparatus including an image bearing member, a charge unit configured to charge the image bearing member, an exposure unit including a light source, the exposure unit configured to cause the light source to emit a light to the image bearing member to form an electrostatic latent image, a developing unit configured to develop an electrostatic latent image formed on the image bearing member to form an image, a transfer unit configured to transfer an image formed on the image bearing member to a recording material and a control unit configured to perform a first control for determining a voltage to be applied to the charge unit, and to perform a second control for determining a light amount of a light emitted from the exposure unit after performing the first control, wherein the first control is a control to calculate a first discharge start voltage by applying a voltage having a positive polarity to the transfer unit and a second discharge start voltage by applying a voltage having a negative polarity to the transfer unit in a condition where the image bearing member is charged by the charging unit, to determine a surface potential of the image bearing member using the first discharge start voltage and the second discharge start voltage, and to determine an input voltage to be applied to the charge unit based on the surface potential, and wherein the second control is a control to charge the image bearing member by applying the input voltage determined in the first control into the charge member, to calculate a third discharge start voltage by applying a voltage having a positive polarity to the transfer unit and a fourth discharge start voltage by applying a voltage having a negative polarity to the transfer unit in a condition where the image bearing member is charged by the charging unit, to determine a surface potential of the image bearing member using the third discharge start voltage and the fourth discharge start voltage, and to determine the light amount based on the determined surface potential.

Another aspect of the present invention is an image forming apparatus including an image bearing member, a charge unit configured to charge the image bearing member, an exposure unit emitting a light onto the image bearing member to form an electrostatic latent image, a transfer unit configured to transfer an image formed on the image bearing member to a recording material, and a control unit configured to perform a first control for determining a voltage to be applied to the charge unit, and to perform a second control for determining a light amount of a light emitted from the exposure unit after performing the first control, wherein the first control is a control to calculate a first discharge start voltage by applying a voltage having a positive polarity to the transfer unit and a second discharge start voltage by applying a voltage having a negative polarity to the transfer unit in a condition where the image bearing member is charged by the charging unit, to determine a surface potential of the image bearing member using the first discharge start voltage and the second discharge start voltage, and to determine an input voltage to be applied to the charge unit based on the surface potential, and wherein the second control is a control to charge the image bearing member by applying the input voltage determined in the first control into the charge member, to calculate a third discharge start voltage by applying a voltage having a positive polarity to the transfer unit and a fourth discharge start voltage by applying a voltage having a negative polarity to the transfer unit in a condition where the image bearing member is charged by the charging unit, to determine a surface potential of the image bearing member using the third discharge start voltage and the fourth discharge start voltage, and to determine the light amount based on the determined surface potential.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

[Image Forming Apparatus]

Figure 1:
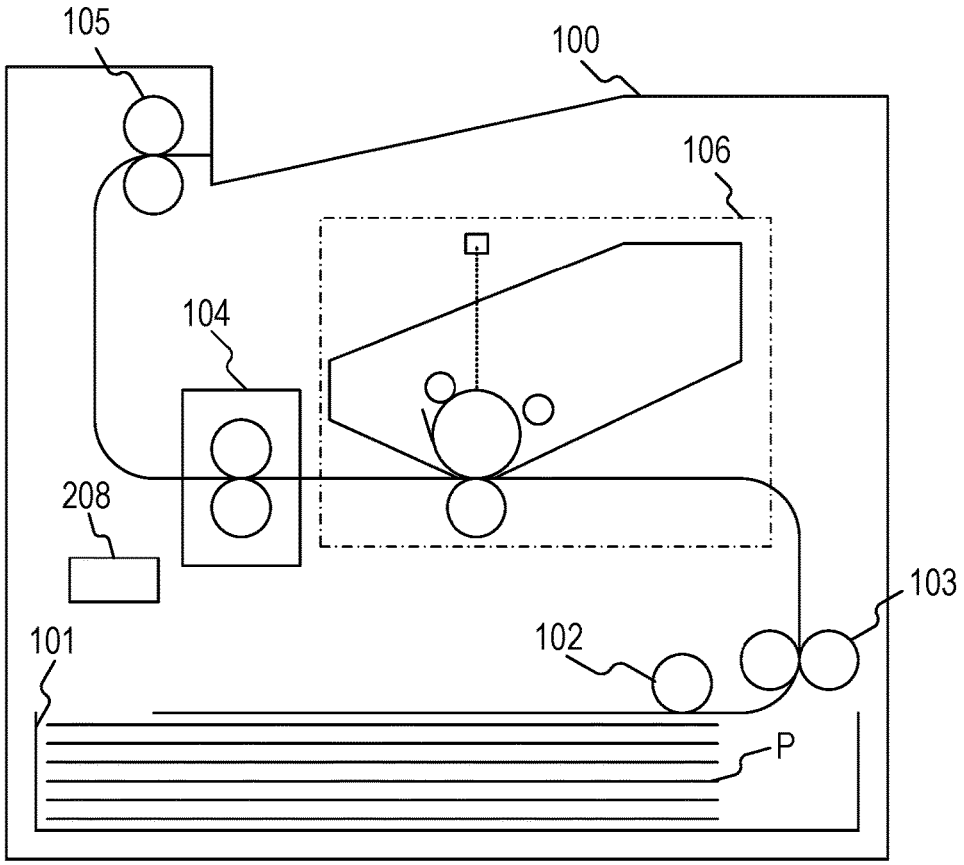
FIG. 1 is a schematic diagram of an image forming apparatus in Embodiments 1 and 2.

FIG. 1 is a diagram schematically illustrating an image forming apparatus in Embodiment 1. An image forming apparatus 100 as an electrophotographic laser beam printer includes a feeding cassette 101 configured to set a sheet P as a transfer member, a pickup roller 102 configured to pick up the sheet P, and a feeding roller 103 configured to feed and convey the sheet P. The image forming apparatus 100 includes a fuser 104 being a fusing unit configured to fuse toner to the sheet P, a discharge roller 105 configured to eject the sheet P, and an image forming unit 106 configured to perform charge and exposure.

The sheet P placed on the feeding cassette 101 is picked up by the pickup roller 102 and fed and conveyed by the feeding roller 103 and a driving unit (not illustrated). A toner image is transferred onto the sheet P by the image forming unit 106, and unfused toner on the sheet P is fused by the fuser 104. The sheet P bearing fused toner image is thereafter ejected to the outside of the image forming apparatus 100 by the discharge roller 105. These operations are controlled by a control unit 208 as a control unit configured to control an operation sequence of the image forming apparatus 100.

Figure 2A:
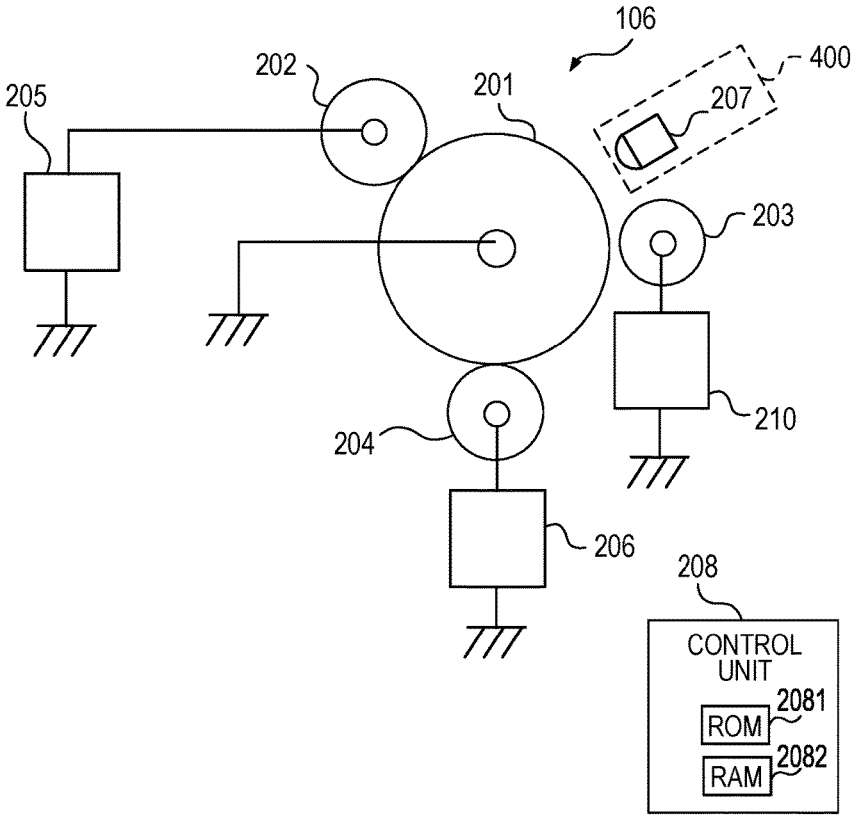
FIG. 2A is a diagram illustrating the major parts of the image forming apparatus in Embodiments 1 and 2.

FIG. 2A illustrates the image forming unit 106 in detail. The image forming unit 106 includes a photosensitive drum 201 as an image bearing member, a charge roller 202 as a charge unit, a transfer roller 204 as a transfer unit, and a developing sleeve 203 as a developing unit. The image forming unit 106 includes a charge voltage application circuit 205 as a first applying unit, a development voltage application circuit 210, a transfer voltage application circuit 206 as a second applying unit, and a laser light source 207. An exposure unit 400 as an exposure unit includes the laser light source 207. The exposure unit 400 is configured to form an electrostatic latent image on the photosensitive drum 201. One of the charge roller 202 and the transfer roller 204 is a member configured to form a potential difference with the photosensitive drum 201.

The photosensitive drum 201 is subjected to what is called an image forming process including charge by the charge roller 202, exposure to laser light (a light) emitted from the laser light source (light source) 207 and the like. The image forming process is controlled by the control unit 208, such as a CPU and ASIC, configured to control the image forming apparatus 100. The control unit 208 includes a ROM 2081 in which various programs which control the image forming apparatus 100 and setting values are stored. The control unit 208 also includes a RAM 2082 in which information is temporarily stored when the various programs are executed.

[Exposure Unit]

Figure 2B:
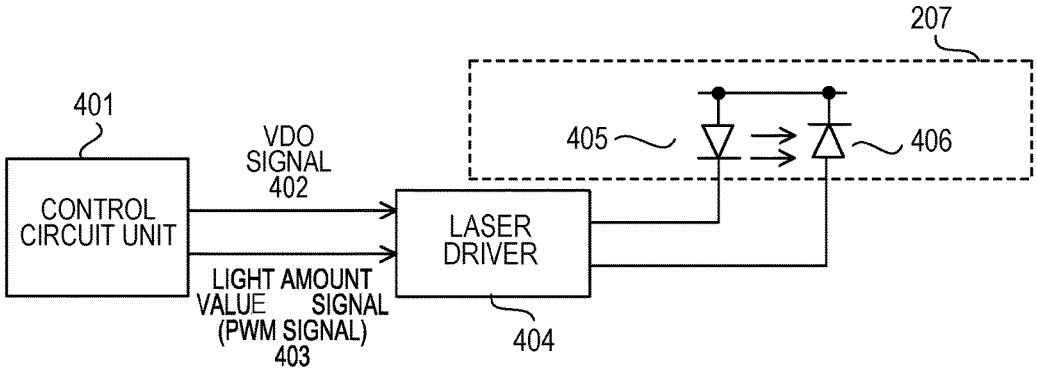
FIG. 2B is a schematic configuration diagram of a laser driving circuit in Embodiments 1 and 2.

FIG. 2B illustrates a schematic diagram of the exposure unit 400 configured to control exposure amount of the laser light source 207. The laser light source 207 includes a laser diode 405 and a photo diode (hereafter, denoted by PD) 406. A laser driver 404 is configured to control a light amount of the laser light source 207 so as to keep the light amount constant, while monitoring the light emission amount of the laser diode 405 with the PD 406. The control circuit unit 401 can output a light amount value signal 403 to the laser driver 404. The light amount value signal 403 is modulated by the pulse width modulation (PWM). The laser driver 404 can change the light amount according to the light amount value signal 403. With this configuration, a light amount of laser light emitted to the photosensitive drum 201 can be changed. A surface potential of the photosensitive drum 201 after laser light is emitted from the laser light source 207 is sensed with the transfer voltage application circuit 206. If the sensed surface potential of the photosensitive drum 201 is different from a predetermined value, the surface potential of the photosensitive drum 201 can be corrected by changing the light amount of the laser light source 207. During image formation, the control circuit unit 401 outputs a VDO signal 402 corresponding to image data to the laser driver 404.

[Transfer Voltage Application Circuit]

Figure 3:
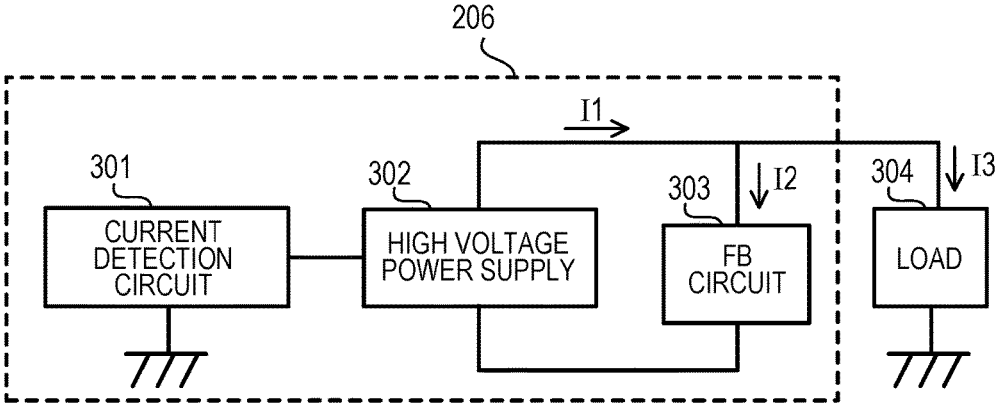
FIG. 3 is a schematic configuration diagram of a transfer voltage application circuit in Embodiments 1 and 2.

FIG. 3 illustrates a schematic configuration of the transfer voltage application circuit 206 in Embodiment 1. The current detection circuit 301 as a detecting unit is a circuit configured to detect a current I1. The current I1 is the sum of a current I2 which flows through a feedback circuit (hereafter, referred to as an FB circuit) 303 and a current I3 which flows through a load 304. The high voltage power supply 302 is a power supply configured to generate a positive transfer voltage and a negative transfer voltage. The positive transfer voltage is a voltage having a positive polarity, and the negative transfer voltage is a voltage having a negative polarity. The FB circuit 303 is a circuit which is provided so that an output voltage from the transfer voltage application circuit 206 is a determined voltage value. The load 304 is a total of loads which lie on a path from the transfer roller 204 to an earth of the photosensitive drum 201. The current I1 is expressed by the following expression (1).

$$I1=I2+I3 \tag{1}$$

The high voltage power supply 302 applies a transfer voltage to the transfer roller 204. The transfer voltage is a direct current voltage. The high voltage power supply 302 includes a constant voltage power supply which can change a polarity of the transfer voltage to one of a positive polarity and a negative polarity. The transfer voltage is generated by the constant voltage power supply. While the constant voltage power supply outputs a voltage, a value of a current which flows through the photosensitive drum 201 is detected by the current detection circuit 301 via the transfer roller 204.

The control unit 208 operates as follows during a time period for which the image formation is not performed (hereafter, referred to as non-image-formation period), for example, a time period before and after the image formation or during a sheet interval. The control unit 208 causes the high voltage power supply 302 to apply different direct current voltages of the constant voltage power supply to the transfer roller 204. The control unit 208 then causes the current detection circuit 301 to detect currents I1 for the respective applications of the different direct current voltages. Based on the currents I1 detected by the current detection circuit 301, the control unit 208 determines a voltage at which discharge is started between the photosensitive drum 201 and the transfer roller 204 (hereafter, referred to as a discharge start voltage). Based on the determined discharge start voltage, the control unit 208 calculates the surface potential of the photosensitive drum 201.

In Embodiment 1, with a charge voltage set at a voltage setting for printing (e.g., −400 [V]), the photosensitive drum 201 is charged. With the photosensitive drum 201 charged, the transfer voltage application circuit 206 applies the transfer voltage to the transfer roller 204. The transfer voltage is one of the positive polarity and the negative polarity. When a charged surface of the photosensitive drum 201 (image bearing member) reaches the transfer roller 204, the current detection circuit 301 detects current values. Here, the control unit 208 performs an operation in which the transfer voltage having the positive polarity and the transfer voltage having the negative polarity are applied to the transfer roller 204 while the transfer voltages are changed, and a plurality of current values is detected. Based on the current values detected by the current detection circuit 301, the control unit 208 determines the discharge start voltage between the photosensitive drum 201 and the transfer roller 204. Using a result of the determination, the control unit 208 calculates a surface potential A of the photosensitive drum 201. The surface potential (hereafter, also referred to as photosensitive drum potential) A of the photosensitive drum 201 is a photosensitive drum potential VD of the photosensitive drum 201 after being charged by the charge roller 202. With the charge voltage applied to the charge roller 202 by the charge voltage application circuit 205, the photosensitive drum 201 is charged by the charge roller 202. In such a state, the surface potential of the photosensitive drum 201 is determined. Such a control is referred to as a first control.

The photosensitive drum 201 is thereafter charged, with the charge voltage similarly set at a predetermined voltage setting. In such a state, the photosensitive drum 201 is exposed by the laser light source 207. A value of the predetermined voltage setting is determined by comparing the result of calculating the surface potential A of the photosensitive drum 201 with a value which is memorized in the ROM 2081 of the control unit 208 beforehand. The control unit 208 changes the setting value of the charge voltage so that the surface potential of the photosensitive drum 201 becomes a desired surface potential.

In such a state, the transfer voltage application circuit 206 applies the transfer voltage to the transfer roller 204. The transfer voltage is one of the positive polarity and the negative polarity. When a charged surface of the photosensitive drum 201 reaches the transfer roller 204, the current detection circuit 301 detects a plurality of current values. Based on the current values detected by the current detection circuit 301, the control unit 208 determines the discharge start voltage between the photosensitive drum 201 and the transfer roller 204. Using a result of the determination, the control unit 208 calculates a surface potential B of the photosensitive drum 201. The surface potential B of the photosensitive drum 201 is a photosensitive drum potential VL of the photosensitive drum 201 after being exposed to laser light by the laser light source 207. With the charge voltage applied to the charge roller 202 by the charge voltage application circuit 205, the photosensitive drum 201 is charged by the charge roller 202 and exposed to the laser light by the exposure unit 400. In such a state, the surface potential of the photosensitive drum 201 is determined. Such a control is referred to as a second control.

Based on a result of determining the surface potential A of the photosensitive drum 201, the control unit 208 changes the setting value of the charge voltage. Based on the result of determining the surface potential B of the photosensitive drum 201, the control unit 208 changes a setting value of the light amount of the laser light source 207. The control unit 208 performs these controls, so that parameters acting on the image formation during printing become appropriate, enabling enhancement of an image quality. That is, the charge voltage which is set based on the result of determining the surface potential A of the photosensitive drum 201, and the light amount of the laser light source 207 which is set based on the result of determining the surface potential B of the photosensitive drum 201 are setting values for the image formation. The setting value of the light amount of the laser light source 207 is set here based on the result of determining the surface potential B of the photosensitive drum 201. However, a similar effect can be obtained by, for example, changing the setting value of the development voltage application circuit 210 based on the result of determining surface potential B of the photosensitive drum 201. The configuration of the control unit 208 is not limited to the configuration described above.

[Method for Calculating Surface Potential of Photosensitive Drum]

Figure 4A:
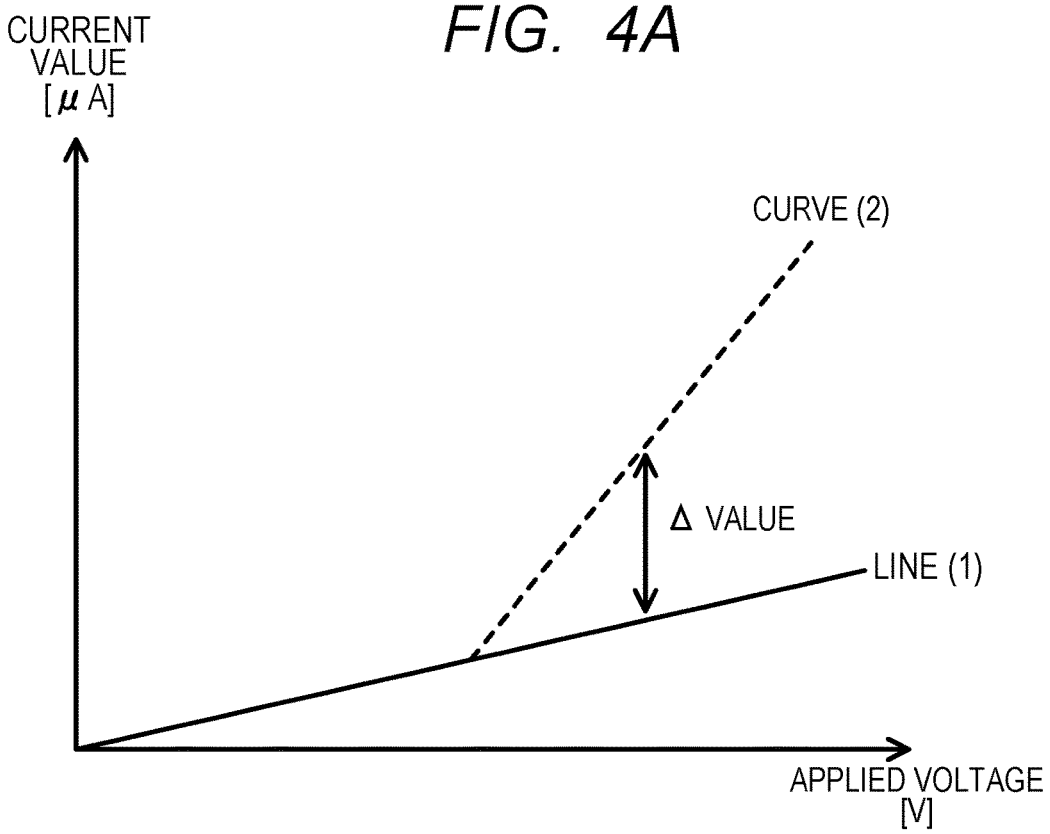
FIG. 4A is a graph illustrating characteristics of an applied voltage and a current value in proximity to a discharge start voltage in Embodiments 1 and 2.

Hereinafter, a method for calculating the surface potential of the photosensitive drum is described more in detail. First, the determination of the discharge start voltage and a method for calculating the surface potential of the photosensitive drum 201 are described. FIG. 4A illustrates a relation between an applied voltage and a current value in proximity to the discharge start voltage. In FIG. 4A, the horizontal axis represents applied voltage [V], and the vertical axis represents current value [μA]. As illustrated in FIG. 4A, until discharge is started between the photosensitive drum 201 and the transfer roller 204, a current in proportion to the applied voltage applied to the photosensitive drum 201 by the transfer roller 204 flows. The current which flows until the start of the discharge is illustrated by a line (1).

However, when the discharge is started between the photosensitive drum 201 and the transfer roller 204, a current comes to flow rapidly. As illustrated by a curve (2), a graph of a current value with respect to the applied voltage is a curve which includes an inflection point. From the fact, a current flows between the photosensitive drum 201 and the transfer roller 204 (hereafter, also referred to as discharge current) can be calculated as a Δ value that is a value obtained by subtracting the line (1) from the curve (2). The control unit 208 determines the applied voltage of a time point at which the A value becomes a predetermined current value (e.g., one of 3 [μA] and −3 [μA]) to be a voltage at which the discharge is started.

Figure 4B:
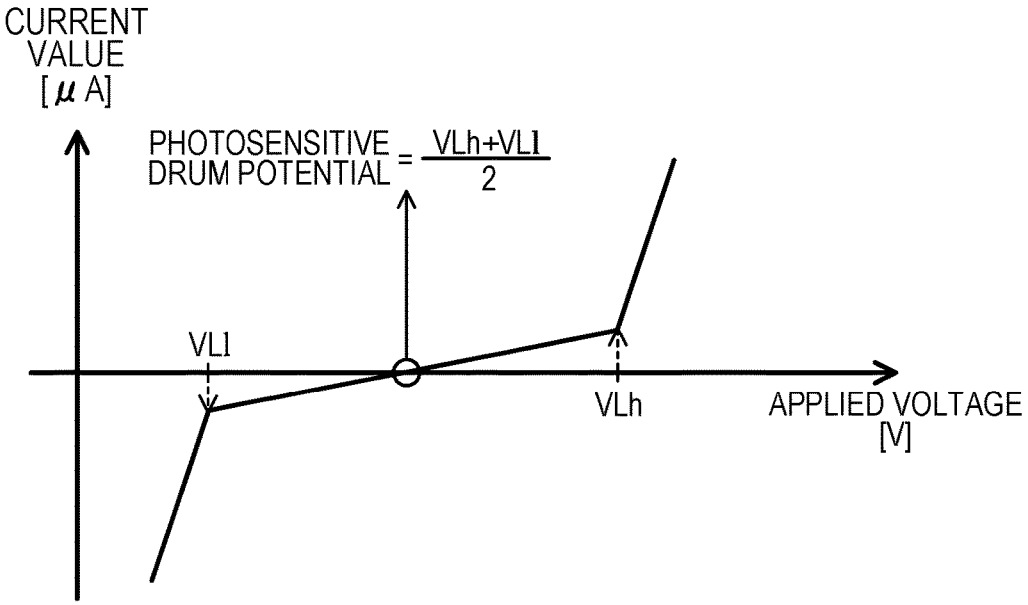
FIG. 4B is a graph illustrating characteristics of an applied voltage to a photosensitive drum and a current value.

According to discharge properties of the photosensitive drum 201, a potential difference necessary for the discharge differs according to differences in environment and a thickness of a film on the photosensitive drum 201. Meanwhile, if surface properties of the transfer roller 204 are equivalent to those of the photosensitive drum 201, potential differences necessary to start the discharge are symmetric in terms of polarity with respect to the surface potential of the photosensitive drum 201, as illustrated in FIG. 4B. These properties are generally known as a discharge phenomenon. Assuming that the relation between the transfer roller 204 and the photosensitive drum 201 is equivalent to a relation of a gap between planes, these properties are equivalent to discharge properties of the gap between the planes, and the surface potential of the photosensitive drum 201 is determined by the expression (2) described later.

FIG. 4B is a graph similar to FIG. 4A. The horizontal axis and the vertical axis of FIG. 4B are the same as those of FIG. 4A. As illustrated in FIG. 4B, assuming that the surface potential of the photosensitive drum 201 (portion marked with "○" in the drawing) is regarded as a reference point, a discharge start voltage on a side on which the applied voltage increases with distance from the reference point (hereafter, referred to as a positive side) is denoted by VLh, and a discharge start voltage on a side on which the applied voltage decreases with distance from the reference point (hereafter, referred to as a negative side) is denoted by VLl. The surface potential of the photosensitive drum 201 is determined as ½ of the sum of VLh and VLl and expressed by the following expression (2).

$$\text{Surface Potential of Photosensitive Drum 201} = (VLh+VLl)/2 \quad (2)$$

Next, a calculation order and a calculation timing of the surface potential of the photosensitive drum 201 are described. As described above, in Embodiment 1, to determine the surface potential of the photosensitive drum 201, the control unit 208 performs the control in an order of the surface potential A and the surface potential B. The reason for this order is that the surface potential B which is a photosensitive drum potential after the exposure by the laser light source 207 changes with the surface potential A which is a photosensitive drum potential after the charge by the charge roller 202. The surface potential B is a surface potential of the photosensitive drum 201 after the surface of the photosensitive drum 201 having the surface potential A is exposed to laser light emitted from the laser light source 207. For that reason, when the surface potential A is changed by changing the setting value of the charge voltage, the surface potential B changes with the change in the surface potential A.

Figure 5A:
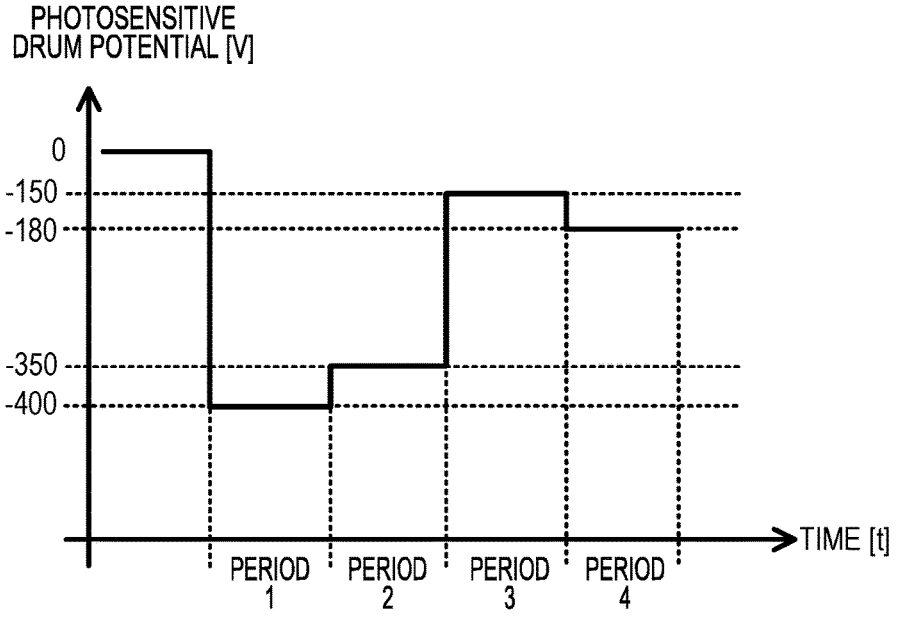
FIG. 5A and FIG. 5B are timing charts used for describing calculation of a surface potential of a photosensitive drum in Embodiment 1.
Figure 5B:
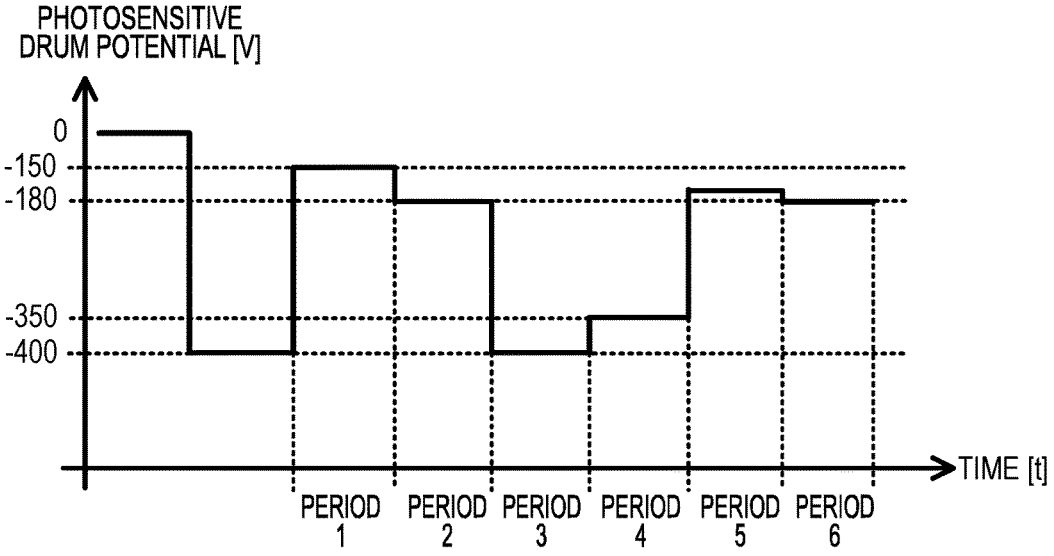

The calculation order and timing are specifically described with reference to FIG. 5A and FIG. 5B. FIG. 5A is a timing chart of a case where the control is performed in the order of the surface potential A and the surface potential B. FIG. 5B is a timing chart of a case where the control is performed in the order of the surface potential B and the surface potential A.

(Control in Order of Surface Potential a and Surface Potential B)

First, a case illustrated in FIG. 5A where the control is performed in the order of the surface potential A and the surface potential B is described. FIG. 5A is a graph illustrating the horizontal axis indicating time [t] and the vertical axis indicating photosensitive drum potential [V]. A period 1 indicates a state where the photosensitive drum 201 is charged to have the surface potential A (−400 [V] in the drawing). The surface potential A is calculated by the control described above. Assume here that an actually-intended surface potential of the photosensitive drum 201 is −350 [V]. In such a case, since the surface potential A of the photosensitive drum 201 obtained within the period 1 is −400 [V], there is an error of 50 (=−350−(−400)) [V] (hereafter, denoted by Δ50 [V]). The control unit 208 thus changes the setting value of the charge voltage within a period 2 so as to adjust the surface potential of the photosensitive drum 201 again. Within the period 2, the surface potential A of the photosensitive drum 201 is the actually-intended surface potential. The control unit 208 accordingly shifts from the control of the surface potential A of the photosensitive drum 201 to the control of the surface potential B of the photosensitive drum 201.

Within a period 3, the control unit 208 charges the photosensitive drum 201 according to the changed setting value of the charge voltage (e.g., a charge voltage of a time when the surface potential of the photosensitive drum 201 is −350 [V]). The control unit 208 then causes the laser light source 207 to perform the exposure. The control unit 208 calculates the surface potential B (−150[V] in the drawing) through the control described above. Assume here that an actually-intended surface potential of the photosensitive drum 201 after the exposure by the laser light source 207 is −180 [V]. In such a case, since the surface potential B of the photosensitive drum 201 obtained within the period 3 is −150 [V], there is an error (amount of change) of Δ30 [V]. The control unit 208 thus changes the setting value of the light amount of the laser light source 207 within a period 4 so as to adjust the surface potential B. During printing performed thereafter, the control unit 208 can enhance an image quality using the setting value of the changed charge voltage and the setting value of the light amount.

In such a manner, the control unit 208 performs the first control to determine a first voltage to be applied to the charge roller 202 by the charge voltage application circuit 205 so that the surface potential of the photosensitive drum 201 becomes a first potential (e.g., −350 [V]). The charge voltage application circuit 205 thereafter applies the first voltage to the charge roller 202 to charge the photosensitive drum 201. In such a state, the control unit 208 performs the second control. The control unit 208 performs the second control to determine the light amount of the laser light source 207 so that the surface potential of the photosensitive drum 201 becomes a second potential (e.g., −180 [V]).

(Control in Order of Surface Potential B and Surface Potential A)

Next, a case illustrated in FIG. 5B where the control is performed in the order of the surface potential B and the surface potential A is described. FIG. 5B is a graph illustrating the horizontal axis indicating time [t] and the vertical axis indicating photosensitive drum potential [V]. FIG. 5B illustrates a state where the photosensitive drum 201 is charged and exposed within the period 1 to be charged at the surface potential B (−150 [V] in the drawing). The control unit 208 calculates the surface potential B through the control described above. Assume here that an actually-intended surface potential of the photosensitive drum 201 after the exposure by the laser light source 207 is −180 [V]. In such a case, since the surface potential B of the photosensitive drum 201 obtained within the period 1 is −150 [V], there is an error of Δ30 [V]. The control unit 208 thus changes the setting value of the light amount of the laser light source 207 within a period 2 so as to adjust the surface potential B.

Subsequently, within the period 3, the photosensitive drum 201 is charged, and the surface potential A (−400 [V] in the drawing) is calculated. Assume here that an actually-intended surface potential of the charged photosensitive drum 201 is −350 [V]. In such a case, since the surface potential A of the photosensitive drum 201 obtained within the period 3 is −400 [V], there is an error of Δ50 [V]. The control unit 208 thus changes the setting of the charge voltage within the period 4 so as to adjust the surface potential A.

During printing performed thereafter, if the setting value of the charge voltage and the setting of the light amount after the change are used, a fault in an image, such as an extremely high or low image density, may occur. For example, in the example illustrated in FIG. 5B, an image density is higher than intended. Such an image density is caused because the image forming process performed in an order of the charge and the exposure, as understood from FIG. 2A. When the setting of the charge voltage for the charge is changed, the surface potential of the exposed photosensitive drum 201 also changes. For that reason, to obtain an appropriate image quality, when the control is performed in the order of the surface potential B (light amount adjustment) and the surface potential A (charge voltage adjustment) as illustrated in FIG. 5B, calculation of the surface potential B within a period 5 and adjustment of the surface potential A within a period 6 need to be performed again. Consequently, the control illustrated in FIG. 5B takes a longer time than the control illustrated in FIG. 5A.

For that reason, the control is desirably performed in the order of the surface potential A and the surface potential B as illustrated in FIG. 5A. The surface potential of the photosensitive drum 201 is calculated in the order of the surface potential A and the surface potential B. The setting value of the charge voltage and the setting value of the light amount are then changed. In such a manner, the sequence time can be improved.

[Calculation Timing of Surface Potential a and Surface Potential B]

The calculation timing of the surface potential A and the surface potential B is described. The calculation of the surface potential of the photosensitive drum 201 is influenced by a surface state of the photosensitive drum 201 because the calculation is performed based on a result of the detection of a current flowing between the photosensitive drum 201 and the transfer roller 204 by the current detection circuit 301. For example, toner used in the previous printing may remain between the photosensitive drum 201 and the transfer roller 204. In such a case, a value of a current flowing between the photosensitive drum 201 and the transfer roller 204 changes, which may lead to a failure of detecting a current value with high accuracy. For that reason, the surface potential of the photosensitive drum 201 is desirably calculated with timing, for example, subsequent to a cleaning sequence for cleaning toner on the photosensitive drum 201 or replacement of a cartridge.

Although toner is described to be a cause of the change in the current value flowing between the photosensitive drum 201 and the transfer roller 204, the current value is similarly influenced by, for example, dust of recording paper. Accordingly, the cause which influences the surface state of the photosensitive drum 201 is not limited to the present configuration. The surface potential of the photosensitive drum 201 is calculated with timing with which the current value flowing between the photosensitive drum 201 and the transfer roller 204 is not influenced by disturbances. In such a manner, a detection accuracy of the surface potential of the photosensitive drum 201 can be enhanced.

[Process of Detecting Surface Potential of Photosensitive Drum]

Figure 6:
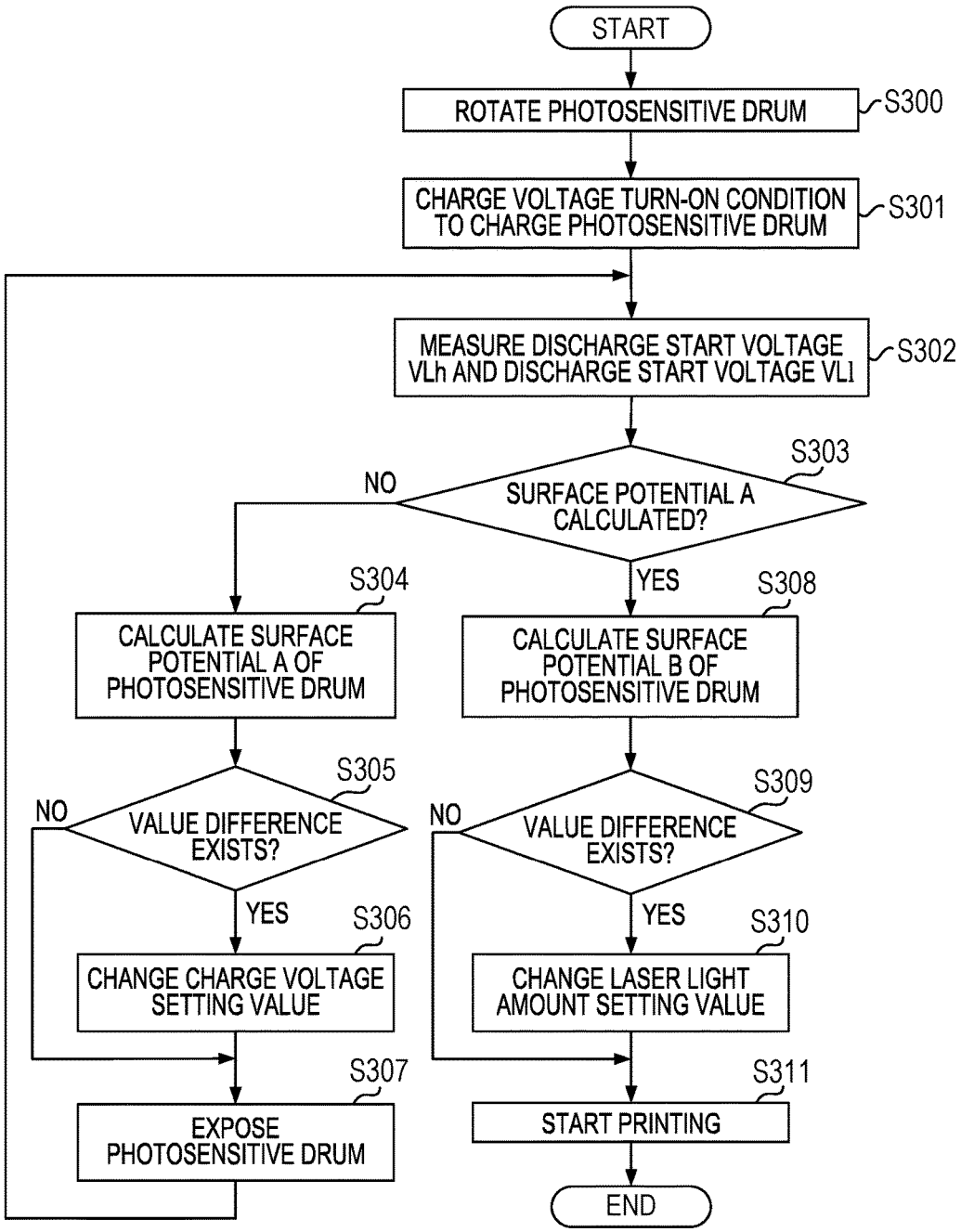
FIG. 6 is a flowchart illustrating a process for calculating the surface potential of the photosensitive drum in Embodiment 1.

The operation described above is controlled by the control unit 208 according to a flowchart illustrated in FIG. 6. The flowchart illustrated in FIG. 6 is described. After a power supply of the image forming apparatus 100 is turned on, or after printing instructions are received, the control unit 208 executes a process of step (hereafter, referred to as S) 300 and subsequent steps. In S300, the control unit 208 starts rotation of the photosensitive drum 201 so as to perform adjustment of various types before printing (hereafter, referred to as calibration). Here, a time period during which the image forming apparatus 100 does not perform the image formation is referred to as a non-image-formation period. In a non-image-formation period from start of the rotation of the photosensitive drum 201 to start of the printing, the control unit 208 performs the above-described adjustment of the charge voltage and adjustment of the light amount of the laser light. In S301, the control unit 208 causes the charge voltage application circuit 205 to apply the charge voltage to the charge roller 202 (charge voltage turn-on condition). The control unit 208 also causes the charge roller 202 to charge the surface of the photosensitive drum 201 to a predetermined potential.

In S302, the control unit 208 measures the discharge start voltage VLh and the discharge start voltage VLl. The control unit 208 causes the transfer voltage application circuit 206 to apply the transfer voltage to the transfer roller 204. The control unit 208 applies to the transfer roller 204 a transfer voltage which lies on a positive side of the surface potential of the photosensitive drum 201. When the current detected by the current detection circuit 301 reaches a predetermined current value, the applied voltage is measured as the discharge start voltage VLh on a positive side. The control unit 208 applies to the transfer roller 204 a transfer voltage which lies on a negative side of the surface potential of the photosensitive drum 201. When the current detected by the current detection circuit 301 reaches a predetermined current value, the applied voltage is measured as the discharge start voltage VLl on a negative side. In S303, the control unit 208 refers to information memorized in the RAM 2082 to determine whether the surface potential A has been calculated. In S303, if the surface potential A is determined not to have been calculated, the control unit 208 advances the process to S304. If the surface potential A is determined to have been calculated, the control unit 208 advances the process to S308.

In S304, the control unit 208 uses the discharge start voltages VLh and VLl measured in S302 to calculate the surface potential A of the photosensitive drum 201 by the expression (2). In S305, the control unit 208 compares a value which is memorized in the ROM 2081 beforehand with the surface potential A calculated in S304. The control unit 208 then determines whether there is a difference between both values. The value which is memorized in the ROM 2081 beforehand is the surface potential of the photosensitive drum 201 which is expected when a predetermined charge voltage is applied in the image formation. If determination is made in S305 that there is a difference between both values, the control unit 208 advances the process to S306. If determination is made in S305 that there is no difference between both values, the control unit 208 advances the process to S307. In S306, the control unit 208 changes the setting value of the charge voltage which is applied to the charge roller 202 by the charge voltage application circuit 205. The control unit 208 then advances the process to S307. To what degree the setting value of the charge voltage should be changed to obtain an expected surface potential of the photosensitive drum 201 is supposed to be determined beforehand through experiments or the like. In S307, the control unit 208 memorizes information indicating that the calculation of the surface potential A is completed (information indicating completion of the calculation) in the RAM 2082. To determine the surface potential B, the control unit 208 causes the laser light source 207 to give out laser light to expose the photosensitive drum 201 to the laser light. The control unit 208 then returns the process to S302.

In S308, the control unit 208 uses the discharge start voltages VLh and VLl measured in S302 to calculate the surface potential B of the photosensitive drum 201 by the expression (2). In S309, the control unit 208 compares a value which is memorized in the ROM 2081 beforehand with the surface potential B calculated in S308. The control unit 208 then determines whether there is a difference between both values. The value which is memorized in the ROM 2081 beforehand is the surface potential of the photosensitive drum 201 which is expected when a predetermined light amount of laser light is emitted in the image formation. If determination is made in S309 that there is a difference between both values, the control unit 208 advances the process to S310. If determination is made in S309 that there is no difference between both values, the control unit 208 advances the process to S311. In S310, the control unit 208 causes the laser driver 404 to change the setting value of the light amount of the laser light source 207. The control unit 208 advances the process to S311. To what degree the setting value of the light amount of the laser light source 207 should be changed to obtain an expected surface potential of the photosensitive drum 201 is supposed to be determined beforehand through experiments or the like. In S311, since the calculation of the surface potential A and the surface potential B is completed, and the image formation operation is ready to be started, the control unit 208 starts the printing and completes the process for calculating the surface potential A and the surface potential B. The control unit 208 calculates the surface potential of the photosensitive drum 201 in the order of the surface potential A and the surface potential B. The control unit 208 then changes the setting value of the charge voltage and the setting value of the light amount of the laser light source 207. In such a manner, an execution time of the sequence can be improved.

As seen from the above, according to Embodiment 1, a potential of a photosensitive drum surface can be detected with high accuracy. Moreover, a time taken to detect the potential of the photosensitive drum surface can be shortened.

Figure 7:
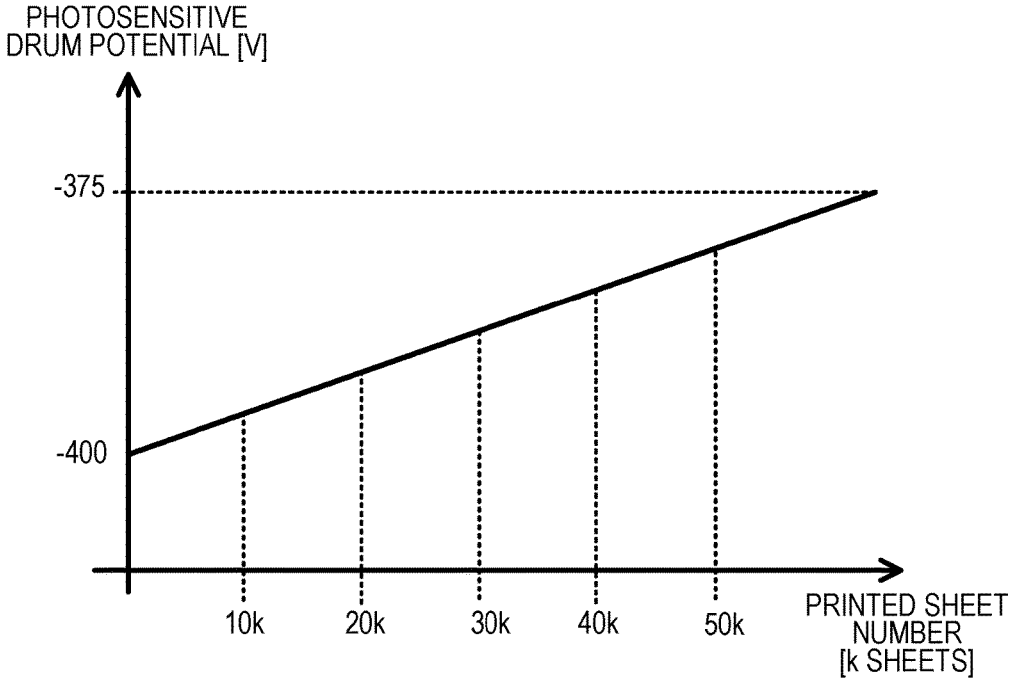
FIG. 7 is a graph illustrating characteristics of a printed sheet number and the surface potential of the photosensitive drum in Embodiment 2.

Next, Embodiment 2 is described. The configurations of an image forming apparatus, a transfer voltage application circuit, and an exposure unit in Embodiment 2 are the same as those in Embodiment 1. The same configurations are denoted by the same reference numerals and are not described. FIG. 7 is a diagram illustrating the horizontal axis indicating a cumulative printed sheet number [k sheets ($10^3$ sheets)] and the vertical axis indicating the surface potential [V] of the photosensitive drum. FIG. 7 illustrates the surface potential of the photosensitive drum 201 when the printed sheet number changes, with the charge voltage kept at, for example, −1200 [V]. Here, the image forming unit 106 is, for example, a cartridge which is attachable/detachable to/from a body of the image forming apparatus 100. The image forming unit 106 has a tag which is a memory unit configured to memorize a total printed sheet number after a new cartridge is mounted on the image forming apparatus 100. The control unit 208 reads the printed sheet number from the tag. The control unit 208 then adds the number of sheets counted with a counter to the read printed sheet number to manage the total printed sheet number. The relation illustrated in FIG. 7 between the printed sheet number and the surface potential of the photosensitive drum 201 is referred to as a printed sheet number-photosensitive drum 201 potential property. Embodiment 2 differs from Embodiment 1 in that the execution time of the sequence can be further improved by determining whether the surface potential A is calculated, using the printed sheet number-photosensitive drum 201 potential property.

In general, with a constant charge voltage (e.g., −1200 [V]) applied to the photosensitive drum 201, the surface potential A of the photosensitive drum 201 varies with the printed sheet number. For example, the surface potential of the photosensitive drum 201 increases with an increase in printed sheet number. The reason for this increase in the surface potential is that charge properties of the photosensitive drum 201 are changed through the charge and the exposure in the image forming process as printing is repeated. For that reason, such a control described in Embodiment 1 needs to be performed every predetermined printed sheet number (e.g., every 1000 sheets) (hereafter, referred to as printed sheet number interval). However, calculating the surface potential A at every predetermined printed sheet number interval increases downtime. Moreover, if the printed sheet number interval for calculating the surface potential A is increased, for example, from 1000 sheets to 10000 sheets, there is a risk that the image quality cannot be corrected appropriately. For that reason, in Embodiment 2, we propose a configuration that allows the improvement of the execution time of the sequence without degrading the image quality. Note that the reason for a control for determining whether the surface potential A has been calculated, using the printed sheet number-photosensitive drum 201 potential property in Embodiment 1 is that the image quality takes priority.

[Printed Sheet Number-Photosensitive Drum Potential Property]

The printed sheet number-photosensitive drum 201 potential property illustrated in FIG. 7 is described. As described above, as printing is repeated, the charge properties of the photosensitive drum 201 are changed through the charge and the exposure in the image forming process. However, as illustrated in FIG. 7, the change of the printed sheet number-photosensitive drum 201 potential property assumes a gentle first-order curve (line). For that reason, the execution time of the sequence can be improved without degrading the image quality by increasing the printed sheet number interval for calculating the surface potential A of the photosensitive drum 201 (e.g., to 5000 sheets) and by predicting and correcting the change in the surface potential A of the photosensitive drum 201 which occurs during the interval.

A correction amount (correction value) of the charge voltage to predict the change in the surface potential A is an amount which is determined beforehand through experiments or the like. The correction amount is memorized beforehand in the ROM 2081 of the control unit 208. For example, the printed sheet number, the surface potential of the photosensitive drum 201, and the correction amount are associated with one another and included in information (e.g., a table) which is memorized in the ROM 2081.

[Process of Detecting Surface Potential of Photosensitive Drum]

Figure 8:
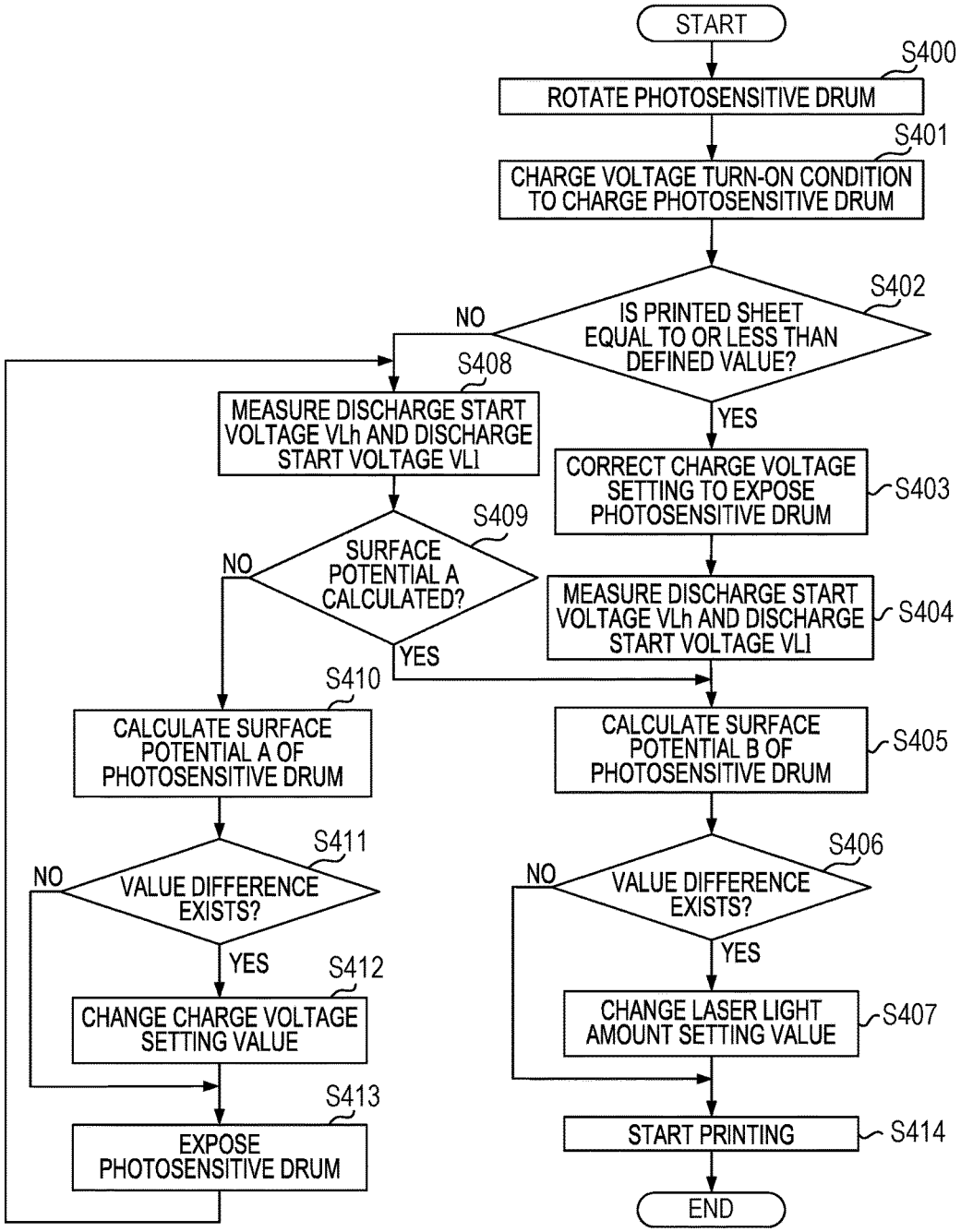
FIG. 8 is a flowchart illustrating a process for calculating the surface potential of the photosensitive drum in Embodiment 2.

The operation described above is controlled by the control unit 208 according to a flowchart illustrated in FIG. 8. After the power supply of the image forming apparatus 100 is turned on, or after printing instructions are received, the control unit 208 starts a process of step 400 and subsequent steps. The control unit 208 executes the process of S400 and subsequent steps in a non-image-formation period for which the photosensitive drum 201 rotates such as for the calibration before printing. The control unit 208 includes a counter (not illustrated) and increments the counter by one when printing of a sheet is completed, so as to manage the printed sheet number. The process of S400 and S401 of FIG. 8 is the same as the process of S300 and S301 of FIG. 6 and thus is not described. In S402, the control unit 208 refers to the counter to determine whether the printed sheet number is equal to or less than a defined number of sheets. If determination is made in S402 that the printed sheet number is equal to or less than the defined number of sheets, the control unit 208 advances the process to S403. If determination is made in S402 that the printed sheet number is more than the defined number of sheets, the control unit 208 advances the process to S408.

In S403, the control unit 208 refers to the information memorized in the ROM 2081 to acquire the correction amount corresponding to the printed sheet number and correct the setting value of the charge voltage according to the acquired correction amount. The control unit 208 causes the charge roller 202 to charge the photosensitive drum 201 using the corrected setting value of the charge voltage and causes the laser light source 207 to perform the exposure. In S404, the control unit 208 measures the discharge start voltage VLh and the discharge start voltage VLl. In S405, the control unit 208 uses the discharge start voltages VLh and VLl measured in S404 and the expression (2) to calculate the surface potential B of the photosensitive drum 201. The process of S406, S407 and S414 is similar to the process of S309 to S311 of FIG. 6 and thus is not described.

If determining in S402 that the printed sheet number is more than the defined number of sheets, the control unit 208 calculates the surface potential A in the process of S408 and subsequent steps. The process of S408 to S413 is similar to the process of S302 to S307 of FIG. 6 and thus is not described. The process of S405 to S407 and S411 for calculating the surface potential B which is executed when the calculation of the surface potential A is completed (YES in S409) is described above and thus is not described.

In Embodiment 2, the control unit 208 determines whether to calculate the surface potential A according to the printed sheet number and change the setting value of the charge voltage, or to correct the setting value of the charge voltage using the correction amount which is set beforehand. Until the printed sheet number reaches the defined number of sheets, the control unit 208 does not calculate the surface potential A, but corrects the setting value of the charge voltage according to the correction amount which is memorized in the ROM 2081 beforehand, so as to correct a change in the surface potential A. In such a manner, also in Embodiment 2, the potential of the photosensitive drum surface can be detected with high accuracy without degrading the image quality. Moreover, a time taken to detect the potential of the photosensitive drum surface can be shortened.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-198119, filed Oct. 6, 2016, which is hereby incorporated by reference herein in its entirety.

What is claimed is:

1. An image forming apparatus comprising:

an image bearing member;

a charge unit configured to charge the image bearing member;

an exposure unit including a light source, the exposure unit configured to cause the light source to emit light to the image bearing member to form an electrostatic latent image;

a developing unit configured to develop the electrostatic latent image formed on the image bearing member to form an image;

a transfer unit configured to transfer the image formed on the image bearing member to a recording material; and a control unit configured to perform a first control for determining a voltage to be applied to the charge unit, and to perform a second control for determining a light amount of light emitted from the exposure unit after performing the first control, wherein the first control is a control to calculate a first discharge start voltage by applying a voltage having a positive polarity to the transfer unit and a second discharge start voltage by applying a voltage having a negative polarity to the transfer unit in a condition where the image bearing member is charged by the charging unit, to determine a surface potential of the image bearing member using the first discharge start voltage and the second discharge start voltage, and to determine an input voltage to be applied to the charge unit based on the surface potential, and wherein the second control is a control to charge the image bearing member by applying the input voltage determined in the first control into the charge member, to calculate a third discharge start voltage by applying a voltage having a positive polarity to the transfer unit and a fourth discharge start voltage by applying a voltage having a negative polarity to the transfer unit in a condition where the image bearing member is charged by the charging unit, to determine a surface potential of the image bearing member using the third discharge start voltage and the fourth discharge start voltage, and to determine the light amount based on the determined surface potential.

2. An image forming apparatus according to claim 1, wherein in a case where a cumulative printed sheet number is equal to or less than a predetermined number of sheets, the control unit corrects the first voltage according to the printed sheet number without the first control, and performs the second control in a condition where the image bearing member is charged by applying a corrected first voltage corrected to the charge member.

3. An image forming apparatus according to claim 2, further comprising a memory unit to store the cumulative printed sheet number, and information corresponding to a surface potential of the image bearing member and a correction value to correct the input voltage to be applied to the charge unit.

4. An image forming apparatus according to claim 3, wherein in a condition where the input voltage to be applied to the charge unit is kept constant, the more the cumulative printed sheet number increases, the higher the surface potential of the image bearing member becomes.

5. An image forming apparatus according to claim 1, wherein the control unit determines the surface potential of the image bearing member during a time period for which image formation is not performed.

6. An image forming apparatus according to claim 1, further comprising a detecting unit configured to detect a current flowing into the image bearing member through the transfer unit, wherein the control unit determines the first, second, third and fourth discharge start voltages based on the current detected by the detecting unit in a case of the input voltage being applied to the transfer unit.

7. An image forming apparatus according to claim 1, wherein the input voltage to be applied to the charge unit determined in the first control is a voltage to be applied to the charge unit in image formation.

8. An image forming apparatus according to claim 1, wherein the light amount of the light source determined in the second control is a light amount of the light emitted from the light source to the image bearing member in image formation.

9. An image forming apparatus comprising:

an image bearing member;

a charge unit configured to charge the image bearing member;

an exposure unit emitting light onto the image bearing member to form an electrostatic latent image;

a transfer unit configured to transfer an image formed on the image bearing member to a recording material; and a control unit configured to perform a first control for determining a voltage to be applied to the charge unit, and to perform a second control for determining a light amount of light emitted from the exposure unit after performing the first control, wherein the first control is a control to calculate a first discharge start voltage by applying a voltage having a positive polarity to the transfer unit and a second discharge start voltage by applying a voltage having a negative polarity to the transfer unit in a condition where the image bearing member is charged by the charging unit, to determine a surface potential of the image bearing member using the first discharge start voltage and the second discharge start voltage, and to determine an input voltage to be applied to the charge unit based on the surface potential, and wherein the second control is a control to charge the image bearing member by applying the input voltage determined in the first control into the charge member, to calculate a third discharge start voltage by applying a voltage having a positive polarity to the transfer unit and a fourth discharge start voltage by applying a voltage having a negative polarity to the transfer unit in a condition where the image bearing member is charged by the charging unit, to determine a surface potential of the image bearing member using the third discharge start voltage and the fourth discharge start voltage, and to determine the light amount based on the determined surface potential.

10. An image forming apparatus according to claim 9, wherein in a case where a cumulative printed sheet number is equal to or less than a predetermined number of sheets, the control unit corrects the input voltage to be applied to the charge unit according to the printed sheet number without the first control, and performs the second control in a condition where the image bearing member is charged by applying a corrected first voltage corrected to the charge member.

11. An image forming apparatus according to claim 9, wherein the control unit determines the surface potential of the image bearing member during a time period for which image formation is not performed.

12. An image forming apparatus according to claim 9, further comprising a detecting unit configured to detect a current flowing into the image bearing member through the transfer unit, wherein the control unit determines the first, second, third and fourth discharge start voltages based on the current detected by the detecting unit in a case of the input voltage applied to the transfer unit.

13. An image forming apparatus according to claim 9, further comprising a developing unit configured to develop the electrostatic latent image formed on the image bearing member.

* * * * *